United States Patent [19]

Tassin et al.

[11] Patent Number: 4,819,391

[45] Date of Patent: Apr. 11, 1989

[54] STAIR BRACKET

[76] Inventors: Larry D. Tassin, P.O. Box 8018, Nashua, N.H. 03060; John W. Ayer, 63 Belmont Dr., Merrimack, N.H. 03054

[21] Appl. No.: 182,951

[22] Filed: Apr. 18, 1988

[51] Int. Cl.[4] ..... E06C 7/50

[52] U.S. Cl. ..... 52/182; 52/712; 52/715

[58] Field of Search ..... 52/182, 188, 712, 715, 52/191

[56] References Cited

U.S. PATENT DOCUMENTS

| | | | |
|---|---|---|---|
| 853,134 | 5/1907 | Steiber | 52/182 |
| 960,412 | 6/1910 | Sandblom | 52/182 |
| 1,893,876 | 1/1933 | Anderson | 52/191 |
| 4,367,613 | 1/1983 | Strub | 52/188 |
| 4,464,870 | 8/1984 | Crepeau | 52/188 |
| 4,593,503 | 6/1986 | Koslowski | 52/182 |
| 4,635,416 | 1/1987 | Ayala | 52/182 |

*Primary Examiner*—David A. Scherbel
*Assistant Examiner*—Lan Mai
*Attorney, Agent, or Firm*—Lee A. Strimbeck

[57] ABSTRACT

A stair bracket for constructing a staircase is formed from a single strip of sheet metal. One edge of the strip at one end and is upturned to form a flange having a length at least equal to the depth of a stair tread, and the same edge at the other end is downturned into a channel having a length at least equal to the height of a riser, the channel and flange meeting in the middle of the strip. In use the strip is bent at a right angle in the middle at the juncture point with the flange being on the inside of the angle and the channel being on the outside.

11 Claims, 1 Drawing Sheet

STAIR BRACKET

Figure 1:
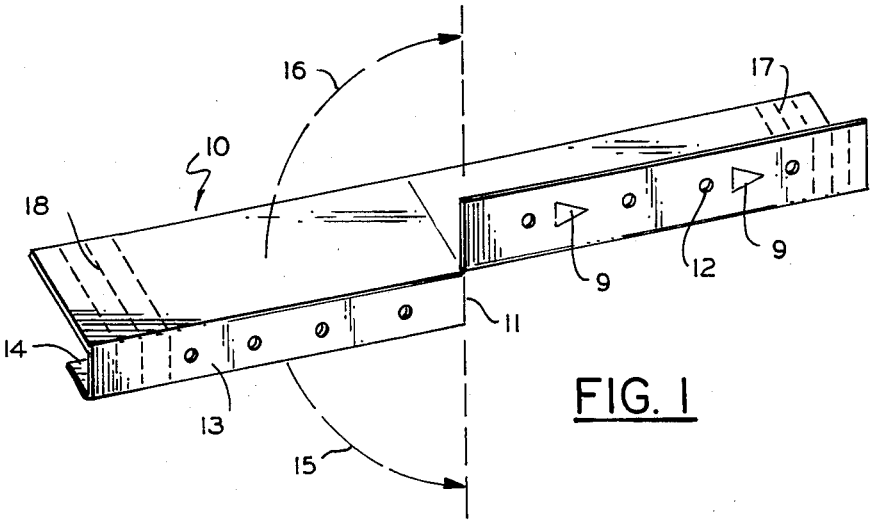

This invention pertains to a metal stair bracket simplifying the construction of stairs and permitting a stronger staircase to be built.

BACKGROUND ART

The following patents disclose methods of and/or brackets for constructing stairs, but do not disclose the bracket configuration of the present invention.

| | |
|---|---|
| U.S. Pat. No. 4,635,416 | January 13, 1987 |
| U.S. Pat. No. 4,593,503 | January 10, 1986 |
| U.S. Pat. No. 4,464,870 | August 14, 1984 |
| U.S. Pat. No. 4,367,613 | January 11, 1983 |

DISCUSSION

For the inexperienced carpenter layer out and constructing staircases can be difficult and time consuming. If a staircase is constructed by conventional methods, it usually requires a considerable amount of labor and thus makes the staircase expensive. Metal brackets are used throughout the construction industry to simplify the assembly of houses and to permit less skilled, less expensive labor to be used. In addition, a stronger construction may be realized. Various types of stair brackets and stair assembly techniques have be proposed in the past. None have gained wide acceptance probably because they did not materially reduce the labor, did not function as intended or were too expensive and complicated.

There has been a desideratum for a stair bracket that a relatively inexperienced carpenter can use to rapidly and effectively assemble a staircase. The present invention is directed to this end.

THIS INVENTION

The present invention is a stair bracket of a lightweight sheet metal adapted to receive sheetrock screws or self taping screws in the assembly of a staircase. The riser of a staircase does not have to be notched. The bracket is adjustable for rise and run. The tread can be modular e.g. 9 ¼ inches and the risers may vary according to the height of the step, but it is possible to have risers modular, e.g. 8 inches.

Once the stringers are in place, and the precut risers, treads and brackets on hand, all the worker needs is a ruler, level and screw gun to quickly assemble a sturdy staircase. The stringer does not have to be notched.

This stair bracket is particularly useful for construction of staircases that are to be carpeted as precut plywood steps and riser can be used. Of course, if a good quality of plywood is used, the staircase can have a natural finish.

By the use of this bracket, assembly times for a staircase can be reduced as much as 60% as compared to the time required to assemble a staircase in a traditional manner.

In brief compass, the present invention is a stair bracket comprising a single strip of metal configured as follows:

(1) Having on one edge a flange formed from the strip, upturned at about 90° and extending a distance from one end of the strip at least equal to the depth of the stair tread, and (2) having on the same edge a channel formed from the strip, the base of which channel downturns from the strip at about 90° the channel extends from the other end of the strip a distance at least equal to the height of a riser.

The flange and channel meet on a line in the middle of the strip.

While the stair bracket may be shipped flat, in use it will be bent at a right angle at the middle between the flange and the channel.

The channel is sized to receive a riser of the thickness desired. The portion of the strip adjacent to the flange receives the stair tread. The flange is fastened to the stringer. The base of the channel may also be fastened to the stringer prior to the insertion of the riser.

As will become apparent in the following description, the stair bracket can quite readily be formed from a single rectangular strip of sheet metal e.g. 16 gauge galvanized steel by simple bending and forming techniques. The ends of the bracket maybe notched or scored to permit snapping of segments of the ends to adjust the length of the riser and tread portions.

DRAWINGS

Figure 2:
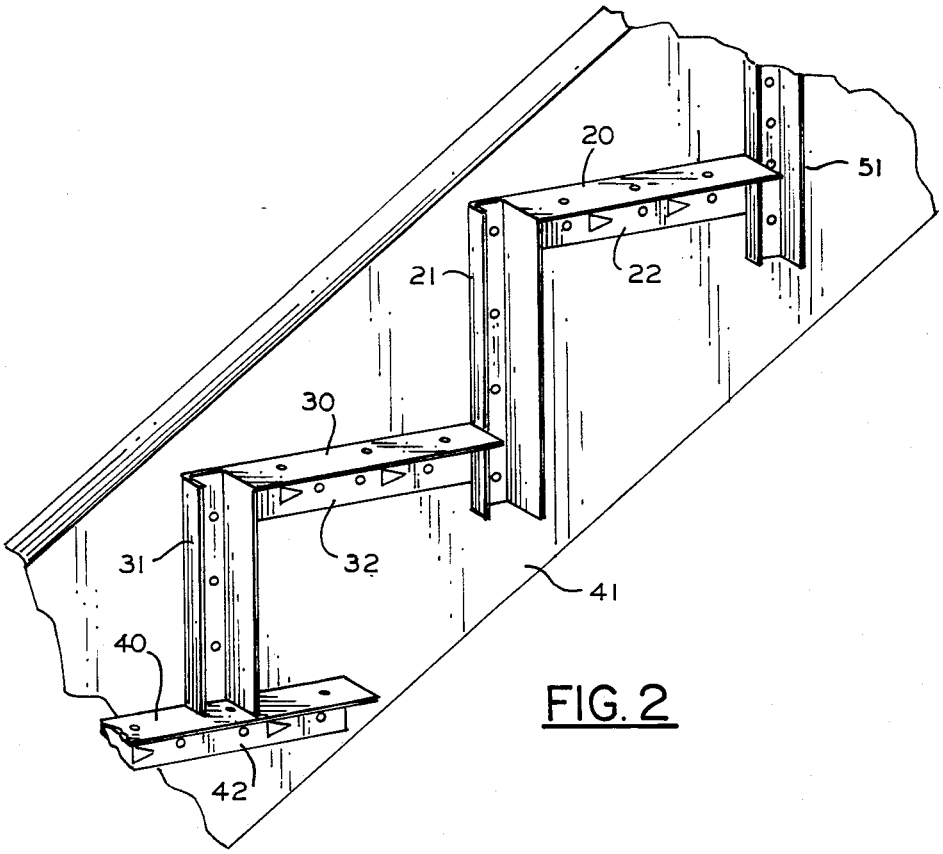

In the drawings:

FIG. 1 depicts the metal stair bracket as it maybe manufactured and shipped and, FIG. 2 shows the metal brackets mounted on a stringer ready to receive the stair treads and risers.

DESCRIPTION

With reference to FIG. 1, shown is a stair bracket of this invention in its configuration when formed from a flat rectangular piece of sheet metal 2¾ to 4 inches wide. The bracket generally indicated at 10 consists of a piece of sheet metal that is cut or slit 1 to 2 inches at 11 with one end of the slit edge 12 being upwardly turned to form a flange as shown. The tab on the other side of slit 11 is downwardly turned at 13 and then is bent again to give an edge 14 forming thereby a channel on the underside of the sheet metal strip. The bends of 12, 13 and 14 are 90° bends.

To form the stair bracket all that is now required is to bend the bracket at the line of the slit 11 moving the channel portion upwardly as indicated by direction arrow 16, which is preferred, or downwardly as indicated by direction arrow 15.

The stair bracket can be shipped in the form shown in FIG. 1 as a series of brackets nestled together so that compact shipping can be realized. The carpenter on the job can then bend the bracket to the right angle configuration shown in FIG. 2 as he applies it.

Flange 12 has a length from one end of the bracket at least equal to the tread depth and the channel 13 has a length from the other end and at least equal to the height of the riser. The ends of the bracket may be scored as indicated at 17 and 18 to permit the ends to be snapped off to adjust the lengths of the riser and treat portions. These markings can also be used as gauges in positioning the bracket.

The bracket can be made from any relatively stiff sheet metal that will accept and hold the bending required. The surfaces 12 and 13 may be pre-punched with holes to accept nails, sheet rock screws or self-tacking screws and desirably have trangular drive-in barbs 9 punched in them to assist in positioning the bracket.

Referring to FIG. 2, shown is a series of brackets, 20, 30 and 40, mounted on a stringer 41. The riser 51 of an additional bracket (not completely shown) also appears. Preferably, flange 12 of FIG. 1 which supports the tread is on the inside of the bracket and the channel for holding the riser is on the outside as shown in FIG. 2. With reference to FIG. 1, if the stairs are not to be carpeted so that the face 14 of the bracket will not be covered then it would be desirable to make the face 14 relatively minimal so that only a very small edge shows against the face of the riser. Face 14 can have a width in the range of $\frac{1}{4}$ to $\frac{3}{4}$ inch for example.

As can be seen from FIG. 2, the riser portions 21 and 51 of the brackets can abut of the tread portions 22 and 32 of the underlying brackets so that any depth of riser can be readily accommodated by the positioning of the brackets. This configuration is preferred. However, the riser can rest on the treat as illustrated by riser 31 resting on tread 42. Of course the surfaces 42 and 32 can be marked with a scale so that each riser portion 31 and 21 can be accurately positioned.

While the ends of the bracket can be scored as at 18 to permit adjustment of the depth of the tread, the bracket is best suited for a modular construction wherein precut treads and risers are supplied along with the brackets. Of necessity, the first riser will have to be cut to a height less than that of the remainder to accommodate the thickness of the tread. The riser end of that bracket can accordingly be hacksawed off to the correct length, or broken off if scored.

The configuration of the risers shown in FIG. 2 were arrived at by bending the preform shown in FIG. 1 upwardly along the motion line indicated at 16 to place the flange 12 on the underside of the treat supporting surface. To arrive at brackets for the other side of the stairwell the configuration shown in FIG. 1 can be bent downward as indicated at 15. This however places flange 12 on the top side of the tread supporting surface and it may show above the top of the tread if the height of the flange 12 is too great. Accordingly, if a single configuration of stair bracket preform is to be used, then it is preferred that flange 12 not have a height greater than one inch and to achieve this it may be necessary to cut back the elongated edge as the preform is being made.

On the other hand, in order to have right and left hand brackets suitable for making a staircase, it may be desirable to make a right hand bracket which is a mirror image of the left hand bracket and to supply the brackets in pairs, e.g. in sets of 12 nestled right hand brackets and 12 nestled left hand brackets.

To strengthen the steps, the inner end of the tread can be fastened to the face of the riser if the riser is allowed to extend below the tread, as would be permitted by the arrangement shown by riser 21 and treat 32, and/or a right angle brace can connect the backside of the riser to the underside of the tread in the middle of the stair.

I claim:

1. A stair bracket for constructing a staircase comprising a strip of sheet metal having originally two parallel, first and second, elongated sides and two, first and second, end edges; said strip being configured as follows;

(a) said strip being partly slit perpendicular to said first elongated edge a distance from said first end at least equal to the depth of a stair tread;

(b) a first flap, created between said first and said slit being turned at the depth of said slit at right angles to the plane of said strip; and (c) a second flap between said second end and said slit being turned at the depth of said slit at right angles to the plane of said strip in the direction opposite said first flap, the elongated edge of said second flap being again turned to a right angle to create a channel between said elongated edge and the plane of said strip.

2. The stair bracket of claim 1 wherein said strip is turned on the line of said slit at right angles.

3. The stair bracket of claim 2 wherein said first flap is on the interior of the right angle of the bracket and said channel is on the exterior.

4. The bracket of claim 1 wherein said channel has the length of a stair riser and a thickness to hold a stair riser.

5. A pair of the bracket of claim 1, one being the mirror image of the other.

6. A pair of brackets of claim 1, one being turned to a right angle on the line of said slit such that said channel is on the outside of the angle, and the other being turned to a right angle on the line of said slit such that said channel is on the inside of the angle.

7. The bracket of claim 1 wherein said strip has a width in the range of $2\frac{3}{4}$ to 4 inches, said slit has a depth in the range 1 to 2 inches.

8. A stair bracket comprising a single strip of metal configured as follows:

(a) having on one edge a flange formed from said strip, upturned at about 90° and extending a distance from one end of said strip at least equal to the depth of a stair tread, and (b) having on the same edge a channel formed from said strip, the base of which channel downturns from said strip at about 90°, said channel extending from the other end of said strip a distance at least equal to the height of a riser, said flange and channel meeting at a line in the middle of said strip.

9. The stair bracket of claim 8 wherein said strip before the forming of said flange and channel is a flat rectangle.

10. The stair bracket of claim 9 wherein said stair bracket is bent at right angles on said line.

11. A staircase comprising paired stringers having affixed to the inner surface thereof a series of apposed paired brackets having the configuration and structure of claim 10 and, a series of treads and riser supported thereby, each pair of said brackets holding a tread and a riser.

* * * * *